US011686175B2

(12) United States Patent
Hovda et al.

(10) Patent No.: US 11,686,175 B2
(45) Date of Patent: Jun. 27, 2023

(54) BEHIND CASING WASH AND CEMENT

(71) Applicant: CONOCOPHILLIPS COMPANY, Houston, TX (US)

(72) Inventors: Lars Hovda, Tananger (NO); Dan Mueller, Houston, TX (US); James C. Stevens, Houston, TX (US); Amal Phadke, Houston, TX (US); Praveen Gonuguntla, San Antonio, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 17/406,669

(22) Filed: Aug. 19, 2021

(65) Prior Publication Data

US 2022/0056782 A1 Feb. 24, 2022

Related U.S. Application Data

(60) Provisional application No. 63/112,427, filed on Nov. 11, 2020, provisional application No. 63/112,448, filed on Nov. 11, 2020, provisional application No. 63/112,440, filed on Nov. 11, 2020, provisional application No. 63/067,599, filed on Aug. 19, 2020.

(51) Int. Cl.

| | |
|---|---|
| ***E21B 33/14*** | (2006.01) |
| ***E21B 41/00*** | (2006.01) |
| ***E21B 37/00*** | (2006.01) |
| ***E21B 33/13*** | (2006.01) |

(52) U.S. Cl.

CPC ..... *E21B 33/14* (2013.01); *E21B 33/13* (2013.01); *E21B 37/00* (2013.01); *E21B 41/0078* (2013.01)

(58) Field of Classification Search

CPC ..... E21B 33/13

See application file for complete search history.

(56) References Cited

U.S. PATENT DOCUMENTS

| | | | | |
|---|---|---|---|---|
| 2,156,207 | A | 4/1939 | Terrill | |
| 3,391,737 | A | 7/1968 | Havens | |
| 2013/0312963 | A1* | 11/2013 | Larsen | E21B 43/114 166/376 |
| 2015/0021025 | A1 | 1/2015 | Myhre et al. | |

(Continued)

OTHER PUBLICATIONS

Phadke, Amal, et al—"Application of Computational Fluid Dynamics for Parametric Optimization of Jet-Type P/W/C Technique", 2020, SPE-202441-MS Society of Petroleum Engineers; 28 pgs.

(Continued)

*Primary Examiner* — William D Hutton, Jr.
*Assistant Examiner* — Avi T Skaist
(74) *Attorney, Agent, or Firm* — ConocoPhillips Company

(57) ABSTRACT

The invention relates to a method of conducting a perf wash cement ("P/W/C") abandonment job in an offshore oil or gas well annulus, in particular the washing or cementing operation using a rotating head with nozzles dispensing wash fluid or cement at pressure. A new design of bottom hole assembly is proposed in which the cementing tool has a relatively large diameter in order to optimize pressure whilst the wash tool has a relatively small diameter. The wash process, for a number of reasons, appears to be less sensitive to tool diameter and making the wash tool smaller reduces the overall risk of stuck pipe.

8 Claims, 6 Drawing Sheets

(56) References Cited

U.S. PATENT DOCUMENTS

| | | | | |
|---|---|---|---|---|
| 2020/0040707 | A1* | 2/2020 | Watts | E21B 37/00 |
| 2020/0173249 | A1* | 6/2020 | Fairweather | E21B 33/13 |

OTHER PUBLICATIONS

Hovda, Lars, et al—"Best Practice for Cementing and Zonal Isolation Using the Jet-Type Perforate, Wash and Cement Technique", 2020, SPE-202397-MS, Society of Petroleum Engineers; 46 pgs.

Ferg, Thomas E.—"Novel Approach to More Effective Plug and Abandonment Cementing Techniques", 2011, SPE 148640, Society of Petroleum Engineers; 13 pgs.

International Search Report for PCT/2021/046719 dated Dec. 6, 2021; 3 pgs.

Medetekova, Maiya—"Production performance of radial waterjet drilled wells: a modelling and laboratory study", 2020, DTU Library; 184 pgs.

Menter, F.R.—"Two-Equation Eddy-Viscosity Turbulence Models for Engineering Applications", 1994, AIAA Journal vol. 32, Issue No. 8, pp. 1598-1605.

* cited by examiner

BEHIND CASING WASH AND CEMENT

CROSS-REFERENCE TO RELATED APPLICATIONS

This application is a non-provisional application which claims benefit under 35 USC § 119(e) to U.S. Provisional Application Ser. No. 63/067,599 filed Aug. 19, 2020, entitled "Jet-Type Perforation-Wash-Cement Parameterization," U.S. Provisional Application Ser. No. 63/112,427 filed Nov. 11, 2020, entitled "Behind Casing Wash and Cement," U.S. Provisional Application Ser. No. 63/112,440 filed Nov. 11, 2020, entitled "Behind Casing Cementing Tool" and U.S. Provisional Application Ser. No. 63/112,448 filed Nov. 11, 2020, entitled "Setting a Cement Plug", each of which is incorporated herein in its entirety.

STATEMENT REGARDING FEDERALLY SPONSORED RESEARCH

None.

FIELD OF THE INVENTION

This invention relates to the process of washing and cementing behind the casing of a well, for example in a so-called perf, wash, cement ("P/W/C") well decommissioning operation.

BACKGROUND OF THE INVENTION

In a P/W/C process for placing cement in the annulus of a well, normally the annulus between casing and wellbore, there are three distinct steps:

- Opening the casing, normally by perforation (explosive, mechanical, abrasive or melt based perforation)
- Washing the annulus between casing and wellbore
- Displacing in plugging material (e.g., cement).

There are currently two basic versions of the wash stage of the P/W/C procedure. The first (the cup technique) involves having upper and lower cup-like sealing elements seal off a length of opened/perforated casing and then passing wash fluid to the region between the cups such that it is forced out through the openings or perforations. With the cup technique, the perforation area is part of the design and the wash fluid is forced under relatively steady pressure. The cup technique is accurately described in Ferg, T., et al "Novel Techniques to More Effective Plug and Abandonment Cementing Techniques", *Society of Petroleum Engineers Artic and Extreme Environments Conference, Moscow,* 18-20 Oct. 2011 (SPE #148640), incorporated herein by reference. The cup technique suffers from the disadvantage that it will often induce loss to the formation. This is because the formation in any given position has a material strength. The combined load from the wash fluid (the hydrostatic pressure) and the wash process (the dynamic pressure) must always be lower than the formation material strength, or downhole losses will occur.

The second type of technique is the so-called jet technique, where jets of wash fluid are emitted from a rotating wash tool within the casing and then jets of cement are emitted from a rotating cementing tool, which is normally part of the same bottom hole assembly as the wash tool. The present invention concerns the jet technique. The jet technique is accurately described in two manuscripts submitted to the Society of Petroleum Engineers (SPE) for publication in November 2020, numbered SPE-202397-MS and SPE-202441-MS. The contents of these papers are incorporated herein by reference.

Although the process is referred to a "cementing" and the plugging material as "cement", it is understood that it is not necessarily limited to the use of cement as such, and any suitable plugging material could be employed; the terms "cement" and "cementing" should be understood accordingly.

Displacement efficiency of the jet-type P/W/C technique has not always been sufficiently high to be considered successful in the past and the inventors have done a considerable amount of work to investigate the reasons for this.

There are many variables which may affect the outcome of the wash and cement operations. The setting of these variables has in the past been a matter of guesswork. The applicant has put considerable resources into determining optimized parameters for delivering wash fluid and cement and some of this work is described in co-pending patent application number US2020/040707A1. The contents of US2020/040707A1 are incorporated herein by reference.

This work has involved a lot of analysis using computational fluid dynamics (CFD) techniques, as well as onshore experimental work using fluid jets in pressurized vessel, and has resulted in a considerably higher degree of confidence that a P/W/C job will have a successful outcome. However, a great many variables are involved and the applicant is continuing its work, largely using CFD, to refine the technique and the various parameters. In particular, the inventors have sought to establish to which parameters the technique is most sensitive and to find optimal ranges which can be employed in practice.

BRIEF SUMMARY OF THE DISCLOSURE

The inventors have appreciated through their CFD work that the efficiency and rate of displacement of fluid in the outer annulus are very dependent on total flow, the direction of axial movement of the tool and the position of the nozzle outlet. Comparing the washing and cementing processes, wash is a high flow operation where the wash tool is normally moving away from the flow outlet (i.e. the "bell nipple" on the drilling unit which effectively means the process is towards a closed end) whilst cement is a relatively low flow operation moving towards the outlet or an open end. BHA geometry can be used to strengthen displacement efficiency and rate.

The inventors have also appreciated through their CFD work that the distance between the wash or cement tool and the interior surface of the casing can be an important factor in whether the existing contents of the annular space behind the casing can effectively be displaced by the wash fluid or cement passing through the casing apertures and into the space behind the casing. This displacement is essential for a good wash or cement job. Furthermore, if more energetic pulses of wash fluid or cement can be created in the outer annulus then it may be possible to achieve sufficient displacement of the existing fluid in the outer annulus using less wash or cement fluid. This can be significant especially when there are constraints on the amount of fluid available. Pulse amplitude and duration may be affected by nozzle selection and tool rpm and there are distinctions between a so-called a primary pulse resulting from a fluid jet passing directly through a casing aperture, and a so-called secondary pulse.

A secondary pulse originates from the energy in the inner annulus, which is the annulus between tool and casing inner diameter. If the jet from the tool impinges upon the inner casing surface instead of passing directly through an aperture in the casing, this will create an energetic flow within the inner annulus; this flow will pass along the inner annulus until it reaches casing apertures through which it can pass. An energetic pulsed flow in the outer annulus is thus created by this secondary mechanism in addition to the primary mechanism of flow being directly jetted through the casing apertures.

The inventors have appreciated through CFD work and practical work performing P/W/C abandonment jobs on wells in the North Sea that the size of the gap between the cement tool and the interior of the casing is one of the most critical factors affecting the energy of the pulses in this inner annulus (determined from CFD work) and therefore the strength of the so-called secondary pulses in the outer annulus. This is supported by data from abandonment jobs in the North Sea, where jobs performed with a cement tool having a larger outer diameter were more reliable.

The inventors have also appreciated that the axial length of this inner annulus between the cement tool and the casing affects the energy of the flow in the inner annulus (and thus the amount of the secondary pulses in the outer annulus). This is especially true of the distance from the cementing nozzles to the top (proximal) end of the cementing tool.

During the wash and cement operations, metal burr from the perforation job or other debris is often released into and/or moved through inner annulus by the fluid; this debris can become lodged thereby potentially preventing rotation of the bottom hole assembly (BHA) and/or axial movement of the BHA. This can necessitate remedial work which can be costly in rig time and in other ways, and the risk of so-called stuck pipe needs therefore to be kept low. Decreasing the inner annulus, i.e., the width of the space (the gap) between tool and casing, and/or increasing the axial length of the space increases flow energy but is likely also to increase the chances of stuck pipe.

Therefore, there is a need to achieve a compromise between maximizing displacement energy and minimizing stuck pipe risk.

An additional factor is that wash fluid is circulated, whilst cement is not. This means that a limited amount of cement is available whereas virtually unlimited wash fluid is available. As a result, it is more important to make the cement job efficient than the wash job; optimizing the fluid pulse energy in the space around the wash tool is less critical than optimizing it around the cementing tool.

The inventors have also very surprisingly found that a CFD modelled wash tool may not be sensitive to tool diameter in the same way a cement tool appears to be. The exact reasons for this are believed to be connected to the effects described in the Brief Summary of the Disclosure. The overall effect on a wash tool is that a reduced diameter OD will maximize the high energy field set up from the high flow pumped towards a closed end. This energy field will itself act as a choke for the "return" flow that needs to turn around and head towards the outlet.

The inventors find that, though a sufficiently good wash can be achieved using nozzles at 90 degrees to the axis of the tool, the wash is improved if angled nozzles are used, especially downwardly angled nozzles or a mixture of upward and downward and 90-degree angles. Based on CFD results, the inventors believe the effect is greater if wash procedure is performed while the tool is moving downwardly (distally) along the casing, based on the comments above about the energy field and also from re-settling effects.

Cementing operations may be performed when the assembly is moving upwardly (proximally) towards the outlet of the flow (the upper/proximal end of the BHA), so that the region outside the casing is filled with cement from the bottom up. In this situation, i.e., moving towards an open end, the inventors believe a small gap between the cementing tool and the casing acts as a choke and increases the contribution from the secondary effect. This is borne out by the CFD modelling.

In their previous work described in US2020/040707A1, the inventors specified that the spacing between the wash nozzles and interior of the casing or the spacing between the cement nozzles and interior of the casing may be between 0.1 and 1.0 inches. However, at that time, the factors outlined above were not fully understood. The inventors now understand that a gap of 0.1 inches may not be ideal since it may increase the risk of stuck pipe.

Since the wash and/or cement tools may not be centralized in the casing, the inventors prefer now to work with values for the outer diameter of the tool and inner diameter of the casing, or the difference between these values, rather than specifying the gap, which may be different on different sides of the tool and may in fact be varying continuously as the tool rotates.

Having determined and in some cases quantified these various factors, the inventors have conceived of a new design of tool/BHA and method of performing a wash and cement job. The design involves having a relatively large diameter of cementing tool and a relatively small diameter of wash tool, for all the reasons mentioned above. This is in contrast to previous designs. The earliest designs in fact had a larger diameter wash tool than cement tool, probably because these designs were used together with a rotating screw/augur device which was thought to facilitate cement entry through the apertures. More recent designs have a substantially constant outer diameter over the whole BHA. The screw/auger is still in use, but its objective is to be a weak link in case of operational issues connected to the perforation debris.

The inventors have found it beneficial if the length of the cementing tool is be increased compared to the current design, in particular the length of the tool above (proximally of) the cementing nozzles.

Many other parameters for washing and cementing may be altered. For example, number and size of nozzles, number and size of perforations, rheology of fluids, rotation, etc. The inventors believe, however, that the improvements described and claimed in this patent application may have a beneficial effect independently of the other parameters. Although the other parameters can affect the quality of cementing and washing, the inventors believe that implementing the improvements described and claimed in this patent application may improve the performance of a wash and cement job even if the other parameters are varied.

According to the invention, a bottom hole assembly and method for performing a P/W/C operation, together with optional features, are described in the appended claims.

In this application the term drift diameter refers to the maximum diameter of object which can pass freely down a certain specification of casing. Whilst the internal diameter of the casing may vary slightly, the drift diameter provides a precise value for a given standard casing size. For example, the drift diameter for 9⅝" inch casing is typically 8.5 inches.

In connection with all aspects of the invention and their respective optional features, the casing diameter may be 103/4 inch (27.31 cm), 9% inch (24.45 cm) or 7¾ inch (19.69 cm) diameter, optionally 103/4 inch (27.31 cm) or 9⅝ inch (24.45 cm) diameter or in the range 5½" to 12" (13.97 cm to 30.48 cm).

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Figure 1A:
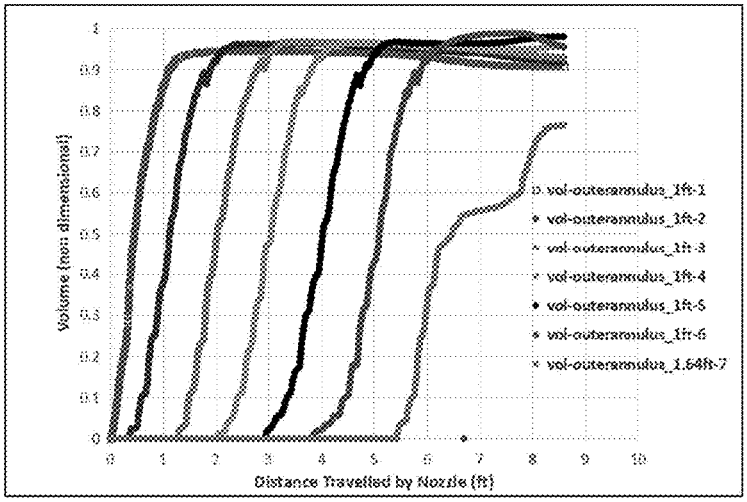
FIGS. 1(*a*), 1(*b*), 1(*c*) and 1(*d*) are graphic results from CFD analysis showing a comparison between modelled cementing tools with different lengths.
Figure 1B:
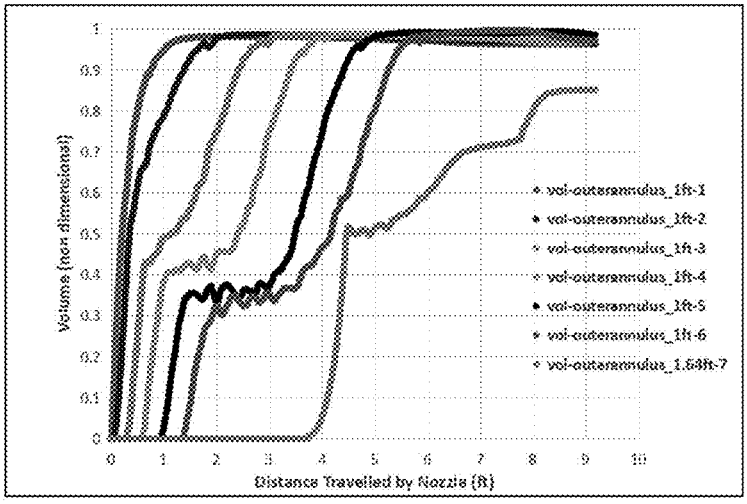
Figure 1C:
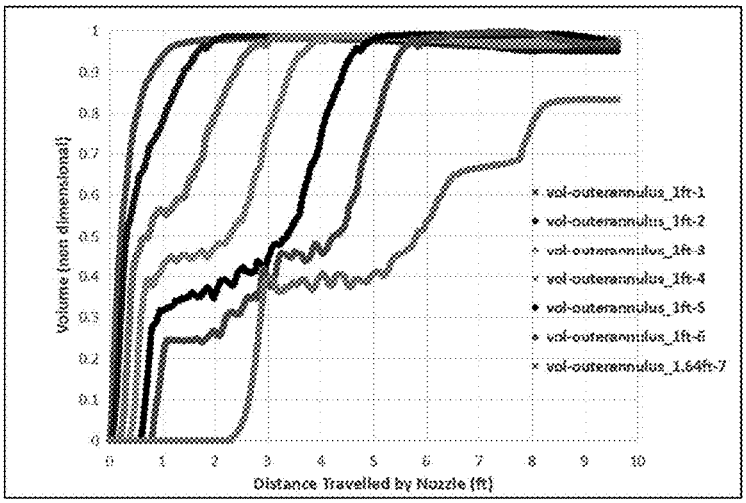
Figure 1D:
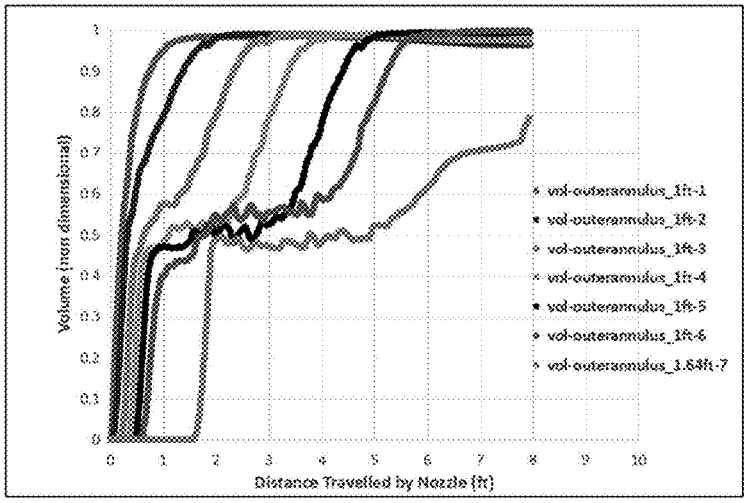

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

In the following examples, the behavior of wash and cement fluid being delivered by cement and wash tools in a casing surrounded by an annulus filled with fluid and debris were modelled. The CFD modelling employed software marketed under the trade name "Fluent" by Ansys Inc. These simulations have since been repeated using a different CFD software package, Star CCM+ marketed by Siemens, and found to give similar results. However, the examples cite here are from the Fluent software. The models were based on a 9⅝" (24.4 cm) casing with an 8½" (20.3 cm) drift diameter. It is believed that the results may be generalized to other casing diameters such as 10¾" (27.3 cm) or 7¾" (19.7 cm) casing.

The CFD model was Reynolds Average Navier Stokes (RANS)-based unsteady multiphase Volume of Fluid (VOF) with multiple interacting phases (fluids). It used S.S.T. k-ω turbulence model in the Fluent software. Debris and wash fluids were modeled as non-Newtonian fluids based on Bingham plastic or Herschel-Bulkley models as appropriate. All fluids were considered homogeneous.

A 12 feet long perforated section of casing was modelled. Typical CFD mesh count ranged from 7~8 million cells. The computational timestep was in the range of 1 ms to 3 ms, adjusted for optimum numerical stability and tool rotational speed. The motion of BHA was simulated via a moving-deforming-layering mesh approach including interface. All perforations in the casing were assumed to be circular with no burr. A mass boundary flow condition was applied at the inlet and a pressure boundary condition at the outlet.

Example 1

The BHA currently in use by the applicant has an 8 inch (20.3 cm) outer diameter for the cement and wash tools. The cementing tool has an overall length of 50.5 cm (19.9 inches), the two nozzles are diametrically opposed and at the same position axially, and the distance between the nozzles and the upper (proximal) end of the tool is 16.8 cm (6.6 inches). In this Example, three other geometries for the cement tool are analysed using CFD analysis: in each case the length of the tool proximally of the nozzles is increased without changing the other dimensions. The increase in length is 30 cm, 60 cm and 120 cm. FIGS. 1(*a*) to 1(*d*) show the four cases FIG. 1(*a*) the standard case (tool as in use today), FIG. 1(*b*) a 30 cm extension, FIG. 1(*c*) a 60 cm extension and FIG. 1(*d*) a 120 cm extension.

Looking at FIG. 1, it can be seen that each diagram includes several plots with the distance travelled by the tool (up) on the x axis and the fraction of fluid displaced (in the outer annulus) on the y axis. The value on the y-axis is presented as a fraction of 1, so that for example 0.2 represents 20%, 0.9 represents 90%, etc. The different plots are of different volumes going down the annulus with the uppermost volume being the first plot. It is simplest to compare the first of plot for each of the four diagrams. As can be seen in FIG. 1(*a*), the first annulus volume reaches a displacement fraction of 0.9 (90%) when the tool has travelled just over 1 foot (just over 30 cm) and the maximum displacement is about 0.95 (95%). Turning now to FIG. 1(*b*), it can be seen that a displacement fraction of 0.9 is reached when the tool has travelled only about 0.7 of a foot (about 21 cm) and the maximum displacement proportion is about 0.97 or 0.98 (97-98%). This clearly demonstrates that there is a benefit to using a longer cementing tool in terms of increasing the proportion of the original annulus content which is displaced by cement (and by implication the likely quality of the cement job).

Turning now to FIGS. 1(*c*) and 1(*d*), these show, respectively, extensions of the cementing tool proximally by 60 cm and 120 cm. Looking at both FIGS. 1(*c*) and 1(*d*), there is hardly any discernable difference from FIG. 1(*b*). A reasonable conclusion is that increasing the cementing tool length by 30 cm provides a distinct benefit, which is also provided by increasing the length more; however, increasing the length beyond 30 cm may not provide an incremental benefit. It would be reasonable to conclude that any proximal extension of the cementing tool from its current length may provide some benefit, however.

Example 2

Figure 2A:
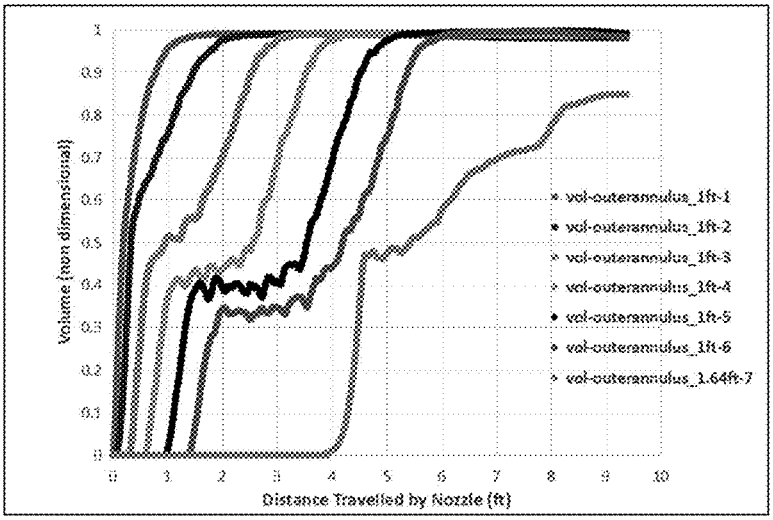
FIGS. 2(*a*) and 2(*b*) are graphic results from CFD analysis of modelled cementing tools having axially spaced nozzles.
Figure 2B:
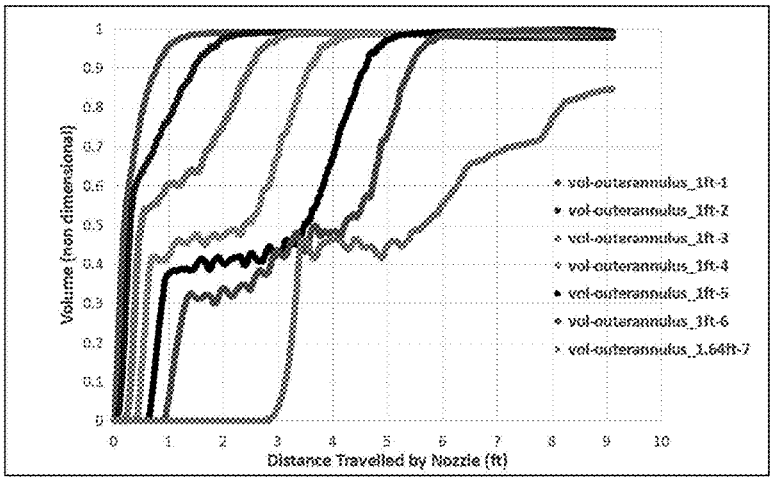

In this example, CFD analysis was performed on the model of FIG. 1(*b*) in Example 1, i.e., a cement tool with a 30 cm extension, but with one of the two nozzles moved axially upwardly/proximally by 8" (20 cm). The result is shown in FIG. 2(*a*) and can be compared to FIG. 1(*b*). Comparing the first plotted line, it can be seen that that the maximum displacement fraction for the tool with spaced or offset nozzles reaches a value of 0.99 (99%) or higher. This compares favorably with the maximum displacement fraction of 0.97-0.98 (97-98%) achieved by the cement tool without offset nozzles.

CFD analysis was also performed using the model of FIG. 1(*c*) in Example 1, i.e., a cement tool with a 60 cm extension, but again with one of the two nozzles moved axially upwardly/proximally by 8" (20.3 cm). The result is shown in FIG. 2(*b*) and can be compared to FIG. 1(*c*). A similar benefit is achieved in terms of maximum displacement fraction although, as with Example 1, there appears to be little difference between the 30 cm and 60 cm extended tools.

Example 3

Figure 3A:
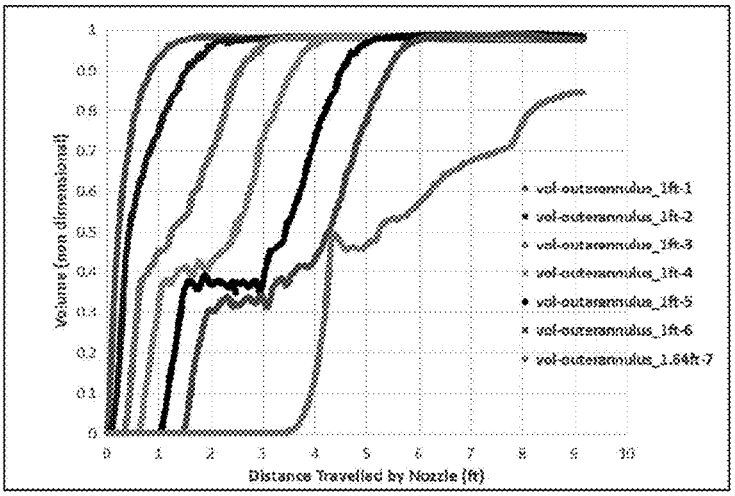
FIGS. 3(*a*), 3 (*b*), and 3(*c*) are graphic results from CFD analysis showing a comparison between modelled cementing tools with different outer diameters.
Figure 3B:
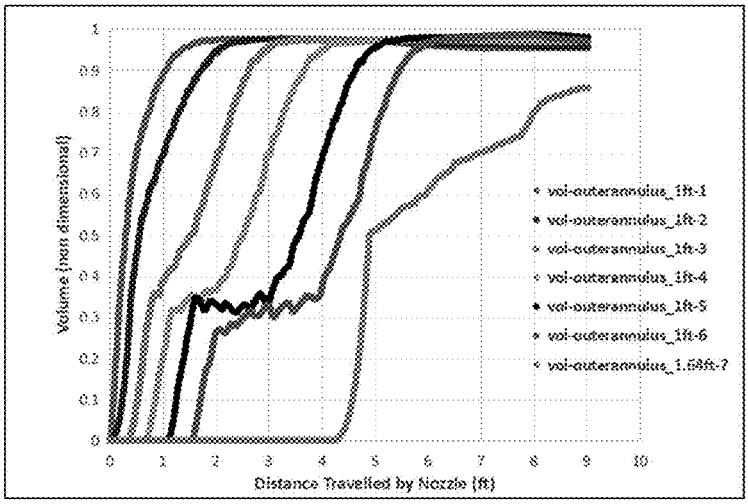
Figure 3C:
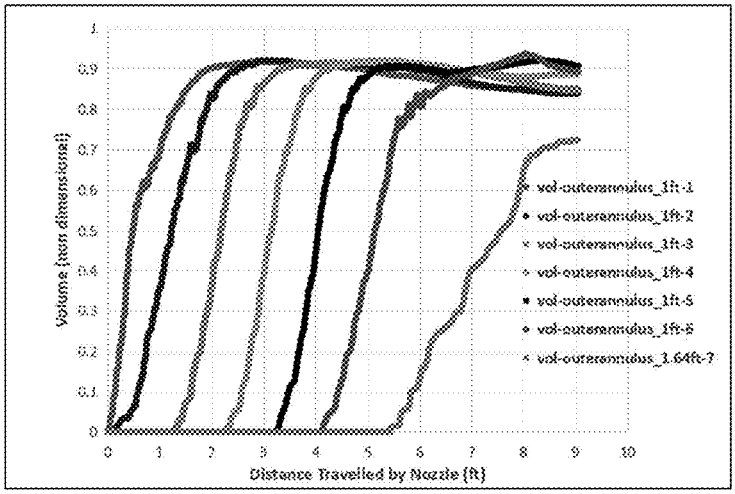

In this example, modelled cementing tools with different outer diameters were analysed using CFD analysis. All the modelled cementing tools were extended proximally by 30 cm and had nozzles offset by 20.3 cm. The aim of the analysis was to determine, by reducing the outer diameter of the tool, at what diameter performance fell significantly. The reference for this Example is FIG. 2(*a*) which is the result for a 30 cm extended tool with 20.3 cm offset nozzles, where the tool outer diameter was modelled at 8.0 inches (20.3 cm). FIG. 3(*a*) shows results for CFD analysis using the same model but with an outer diameter of 7⅝ inches (20.0 cm). It can be seen from examining the first plot in the diagram that the performance is affected somewhat. The tool moves though approximately 0.8 feet (24 cm) before achieving a displacement fraction of 0.9 (90%) and the maximum displacement fraction achieved is around 0.98 (98%).

FIG. 3(*b*) shows the results for a model which is the same in all respects except that the outer diameter is reduced to 7¾ inches (19.7 cm). Looking at the first plot, 0.9 (90%) displacement fraction is not achieved until the tool has moved by 1 foot (30 cm) and the maximum displacement fraction is reduced slightly.

FIG. 3(*c*) shows the results for a model in which the outer diameter is reduced to 7¼ inches (18.4 cm). Looking at the first plot, it can be seen that performance has fallen off significantly, with 0.9 (90%) displacement fraction not being achieved until the tool has moved about 2 feet (60 cm) and the maximum displacement fraction being about 0.92 (92%). The inventors believe, based on practical experience, that these results show that an actual tool with these dimensions may provide inadequate displacement of cement.

The results for the 7⅝ inch (20.0 cm) and 7¾ (19.7 cm) outer diameter tools are believed to be acceptable, so that the cut off between acceptable and unacceptable performance appears to lie somewhere between 7¾ (19.7 cm) and 7¼ inches (18.4 cm).

Example 4

In this example, a wash tool was modelled using CFD. The wash tool was modelled with a total of 10 nozzles, 2 of which were inclined upwardly at 45 degrees, 4 downwardly at 45 degrees and (between them) 4 nozzles perpendicular to the tool axis. The purpose of this work was primarily to compare the performance of a wash tool with this design and having an 8.0 inch (20.3 cm) outer diameter and a similar wash having a much smaller outer diameter of 5.5 inches (14.0 cm). The results are shown in FIGS. 4(*a*) and 4(*b*).

Figure 4A:
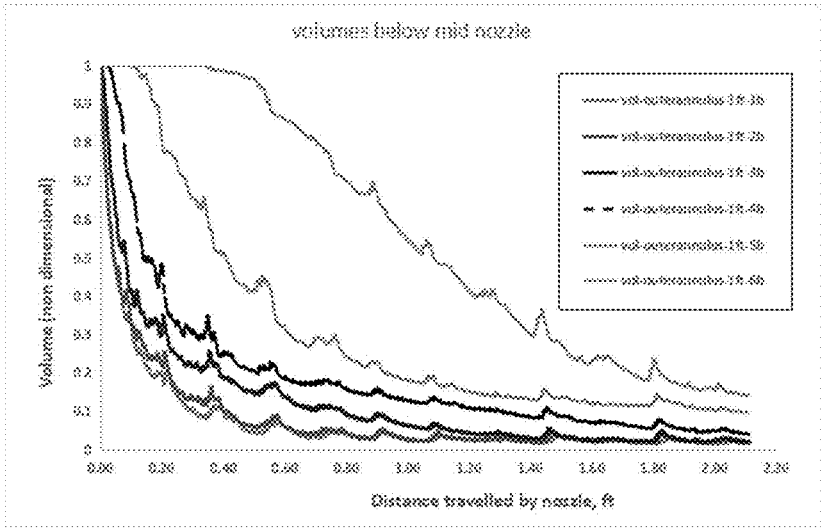
FIGS. 4(*a*) and 4(*b*) are graphic results from CFD analysis showing a comparison between modelled wash tools with different outer diameters.
Figure 4B:
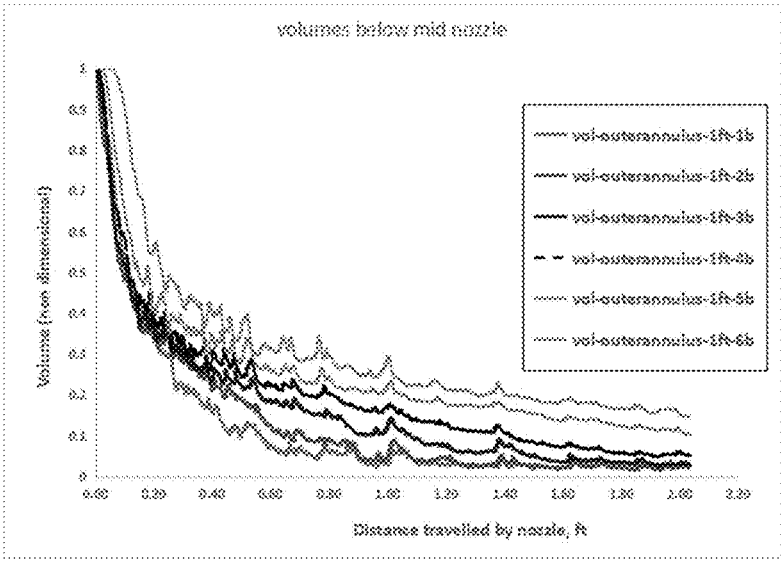

Referring firstly to FIG. 4(*a*), the volume on the y axis represents the fraction of remaining original fluid in the annulus (represented as a fraction of 1), so that for example a value of 0 indicates that the wash fluid has displaced all of the original contents of the annulus. The wash tool is modelled travelling over an axial distance of about 2 feet (60 cm) in a downward/distal direction, and this is represented on the x axis. The individual plots show the modelled displacement in each of a series of 1 foot (30 cm) long sections of the outer annulus, with the first in the list being the uppermost or most proximal section which the wash tool passes first in its downward travel.

As can be seen from the diagram, the first plot shows, naturally, the uppermost/most proximal section of annulus being displaced to wash fluid more quickly than the others. After 2 feet (60 cm) of travel, there is only about 0.02 (2%) of the original fluid remaining in the annulus. The lower sections of annulus are progressively less efficiently washed, though it should be noted that in a real situation the wash tool will travel further than 2 feet (60 cm) so that these sections will in fact receive more washing.

FIG. 4(*b*) shows the modelled small (5.5", 14.0 cm) tool. It is immediately apparent that the washing effect of this tool is at least equivalent, and in some respects somewhat better, than that of the modelled 8" (20.3 cm) tool. The first section is washed more slowly, but by the 2 foot (60 cm) point a similar displacement is achieved to that achieved by the 8" (20.3 cm) tool. After 2 feet (60 cm) the lowest section is also displaced to about the same extent as by the 8" (60 cm) tool, but it appears to achieve this level of displacement more quickly.

When viewed in the light of the results from the cement tool modelling, where reduction of the tool diameter to 7¼ inches (18.4 cm) had a marked negative effect on performance, these results were very notable, and bear out the inventors understanding as set out in, for example, in the Brief Summary of the Disclosure.

REFERENCES

All of the references cited herein are expressly incorporated by reference. The discussion of any reference is not an admission that it is prior art to the present invention, especially any reference that may have a publication date after the priority date of this application. Incorporated references are listed again here for convenience:

Ferg, T., et al "Novel Techniques to More Effective Plug and Abandonment Cementing Techniques", *Society of Petroleum Engineers Artic and Extreme Environments Conference, Moscow,* 18-20 Oct. 2011 (SPE #148640).

US2020/040707A1 (ConocoPhillips)

The invention claimed is:

1. A method of performing a plug and abandon operation in an oil or gas well having a casing, the method including:

a. passing through the casing a bottom hole assembly comprising a generally cylindrical wash tool having a plurality of wash fluid nozzles and, axially connected to the wash tool, a generally cylindrical cementing tool having one or more cement nozzles, wherein the outer diameter of the wash tool is less than the outer diameter of the cementing tool, and the outer diameter of the wash tool is about 2.54 cm to 10.16 cm smaller than the drift diameter of the casing and the outer diameter of the cementing tool is about 0.64 cm to 2.54 cm smaller than the drift diameter of the casing;

b. delivering wash fluid through apertures in the casing into a region outside the casing; and c. delivering cement through the apertures into the region outside the casing.

2. The method according to claim 1, wherein the outer diameter of the wash tool is selected from about 2.54, 3.81, 5.08, 6.35, 7.62, 8.89 and 10.16 cm smaller than the drift diameter of the casing and the outer diameter of the cementing tool is selected from about 0.64, 1.27, 1.9 and 2.54 cm smaller than the drift diameter of the casing.

3. The method according to claim 1, wherein the length of the cementing tool is selected from about 60, 70, 80, 90, 100, 110, 120, 130, 140 and 150 cm long.

4. The method according to claim 1, wherein position of the cement nozzle nearest the upper end of the cementing tool is selected from about 26, 30, 36, 40, 46, 50, 60, 70, 80, 90, 100, 110, and 120 cm from the upper end.

5. The method according to claim 1, wherein two nozzles of the cementing tool are spaced apart axially by a distance selected from at least 5.08, 7.62, 10.16, 12.70, 15.24, 17.78 and 20.32 cm.

6. The method according to claim 1, wherein some or all of the wash nozzles of the wash tool are angled at angle selected from about 10, 20, 30, 40, 50, 60, 70, and 80 degrees to the axis of the tool.

7. The method according to claim 1, wherein some or all of the wash nozzles are angled downwardly.

8. The method according to claim 1, wherein the cementing tool is connected to the upper end of the wash tool.

* * * * *